US009282817B2

(12) United States Patent
Yates

(10) Patent No.: US 9,282,817 B2
(45) Date of Patent: Mar. 15, 2016

(54) SUPPORT RACK AND METHOD OF SUPPORTING ONE OR MORE ELONGATED OBJECTS

(71) Applicant: Roy E. Yates, Freeport, TX (US)

(72) Inventor: Roy E. Yates, Freeport, TX (US)

(73) Assignee: Roy E. Yates, Freeport, TX (US)

( * ) Notice: Subject to any disclaimer, the term of this patent is extended or adjusted under 35 U.S.C. 154(b) by 0 days.

(21) Appl. No.: 14/173,130

(22) Filed: Feb. 5, 2014

(65) Prior Publication Data

US 2015/0216301 A1 Aug. 6, 2015

(51) Int. Cl.
*A47F 7/00* (2006.01)
*A47B 81/00* (2006.01)

(52) U.S. Cl.
CPC ..... *A47B 81/005* (2013.01); *Y10T 29/49826* (2015.01)

(58) Field of Classification Search
CPC . A01K 97/10; A47B 81/005; Y10T 29/49826
USPC ..... 211/70.8
See application file for complete search history.

(56) References Cited

U.S. PATENT DOCUMENTS 1,108,432 A * 8/1914 Foster ..... 294/159
1,226,231 A * 5/1917 Mack ..... 211/119.009
1,634,953 A * 7/1927 McCune et al. ..... 211/13.1
1,687,138 A * 10/1928 Myers ..... 211/72
2,854,147 A 9/1958 Derr
3,291,427 A 12/1966 Hutchings
3,319,910 A 5/1967 Collin
3,537,595 A 11/1970 Mathisen
3,701,504 A 10/1972 Woods
3,939,594 A 2/1976 Wagner
4,003,612 A 1/1977 Munsell
4,006,825 A 2/1977 Austin
4,067,134 A 1/1978 Billings
4,326,648 A * 4/1982 Kieber ..... 222/162
4,326,761 A * 4/1982 Schwartz ..... 312/326
4,460,117 A 7/1984 Smalls
4,485,578 A 12/1984 Novey
4,688,685 A 8/1987 Brace
4,779,914 A 10/1988 Friedline
4,880,122 A * 11/1989 Martindell ..... 211/70.6
4,986,427 A 1/1991 Law
5,115,598 A 5/1992 Shaw
5,257,700 A 11/1993 Wallace
D353,294 S 12/1994 Belokin et al.
D354,874 S 1/1995 Burch
D357,607 S 4/1995 Nilsson
5,588,542 A 12/1996 Winkler
5,657,883 A 8/1997 Badia
5,676,261 A 10/1997 Baughman (Continued)

*Primary Examiner* — Korie H Chan
(74) *Attorney, Agent, or Firm* — Reed Smith LLP; Robert R. Riddle

(57) ABSTRACT

A support rack includes a first plate extending in a first plane. At least two spaced-apart openings extend through the first plate. A second plate extends in a second plane. The second plane may be parallel to and spaced-apart from the first plane. A third plate extends from the first plate to the second plate. The third plate extends in a third plane. The third plane extends perpendicularly to both the first and second planes. At least one tab extends outwardly from the third plate and between the first and second plates. The tab extends perpendicularly to the third plane and parallel to both the first and second planes. The tab includes an opening extending therethrough. The opening of the tab is aligned with one of the openings of the first plate along a common longitudinal axis.

14 Claims, 6 Drawing Sheets

(56) References Cited

U.S. PATENT DOCUMENTS

| | | | | |
|---|---|---|---|---|
| 5,678,700 | A * | 10/1997 | Crosson, Jr. | 211/70.8 |
| D392,142 | S | 3/1998 | Weisburn et al. | |
| 5,873,192 | A | 2/1999 | Chiu | |
| 5,979,102 | A | 11/1999 | Sagryn | |
| 6,213,441 | B1 | 4/2001 | Baynard | |
| 6,250,480 | B1 | 6/2001 | McGuinness | |
| 6,276,539 | B1 | 8/2001 | Richbourg | |
| 6,360,902 | B1 | 3/2002 | Searles | |
| 6,499,248 | B2 | 12/2002 | Thompson | |
| 6,530,170 | B1 | 3/2003 | Sweeney | |
| 6,533,132 | B1 | 3/2003 | Weisenburger | |
| 6,932,224 | B1 | 8/2005 | Sandberg | |
| 7,175,031 | B2 * | 2/2007 | Matthews | 211/70.6 |
| D537,771 | S * | 3/2007 | Pflieger | D12/406 |
| 7,237,685 | B2 | 7/2007 | Keegan | |
| D554,929 | S | 11/2007 | Jajdelski | |
| D575,972 | S | 9/2008 | Shiao | |
| D578,962 | S | 10/2008 | Foreman et al. | |
| D585,371 | S | 1/2009 | Foreman et al. | |
| 7,559,428 | B2 | 7/2009 | Matzick | |
| D598,227 | S | 8/2009 | Oakes | |
| D609,517 | S | 2/2010 | Oakes | |
| D612,216 | S | 3/2010 | McQuary et al. | |
| 7,707,765 | B2 | 5/2010 | Liao | |
| D632,651 | S | 2/2011 | Foreman et al. | |
| D659,302 | S * | 5/2012 | Rose | D30/133 |
| D661,126 | S | 6/2012 | Hester | |
| 8,272,611 | B2 * | 9/2012 | Schmidt et al. | 248/312 |
| D674,506 | S | 1/2013 | LaBrasca | |
| D674,620 | S | 1/2013 | Petrick et al. | |
| D689,777 | S | 9/2013 | Castaing | |
| 8,845,985 | B2 * | 9/2014 | Herchenbach et al. | 422/562 |
| 2005/0194331 | A1 | 9/2005 | Chang | |
| 2008/0115401 | A1 | 5/2008 | Roemer | |
| 2009/0308822 | A1 | 12/2009 | Byers | |

* cited by examiner

SUPPORT RACK AND METHOD OF SUPPORTING ONE OR MORE ELONGATED OBJECTS

BACKGROUND

The present disclosure is directed generally to a support rack and a method of supporting one or more elongated objects.

Support racks for supporting elongated objects, such as fishing rods, are known. Certain prior art support racks are free-standing, while others may be attached to a wall. Despite the benefits provided by such prior art devices, at least certain known support racks have readily apparent disadvantages.

Certain free-standing prior art support racks are relatively easy to knock over. It can also be difficult to insert or remove the fishing rods from prior art support racks. Wall-mounted prior art support racks are typically made from two or more wood pieces, and often include rubber grommets or clips that must be affixed to the rods.

A relatively simple and cost effective support rack has yet to be developed. The present invention overcomes the above-identified disadvantages of the prior art, and accomplishes the above and other objectives.

SUMMARY

One embodiment of the present disclosure is directed generally to a support rack including a first plate extending in a first plane. At least two spaced-apart openings extend through the first plate. A second plate extends in a second plane. The second plane may be parallel to and spaced-apart from the first plane. A third plate extends from the first plate to the second plate. The third plate extends in a third plane. The third plane extends perpendicularly to both the first and second planes. At least one tab extends outwardly from the third plate and between the first and second plates. The tab extends perpendicularly to the third plane and parallel to both the first and second planes. The tab includes an opening extending therethrough. The opening of the tab is aligned with one of the openings of the first plate along a common longitudinal axis.

Another embodiment of the present disclosure is directed generally to a method of supporting one or more elongated objects. The method includes attaching at least a portion of a support rack to at least one of a ceiling and a wall and inserting at least a portion of the elongated object into at least one opening formed in the support rack such that the elongated object extends at least generally parallel to a plane defined by the ceiling.

Another embodiment of the present disclosure is directed generally to a combination that includes at least two fishing rods and a support rack. The support rack includes a first plate extending in a first plane. At least two spaced-apart openings may extend through the first plate. A second plate extends in a second plane. The second plane is parallel to and spaced-apart from the first plane. A third plate extends from the first plate to the second plate. The third plate extends in a third plane. The third plane extends perpendicularly to both the first and second planes. At least two-spaced apart tabs extend outwardly from the third plate and between the first and second plates. Each tab extends perpendicularly to the third plane and parallel to both the first and second planes. Each tab includes an opening extending therethrough. The opening of each tab is aligned with one of the openings of the first plate along a common longitudinal axis. The support rack is configured to support the at least two fishing rods. Each fishing rod is inserted into one of the at least two spaced-apart openings of the first plate and the opening of one of the at least two spaced-apart tabs.

DRAWINGS

The foregoing summary, as well as the following detailed description of the invention, will be better understood when read in conjunction with the appended drawings. For the purpose of illustrating the invention, there are shown in the drawings various illustrative embodiments. It should be understood, however, that the invention is not limited to the precise arrangements and instrumentalities shown. In the drawings.

DESCRIPTION

Figure 1:
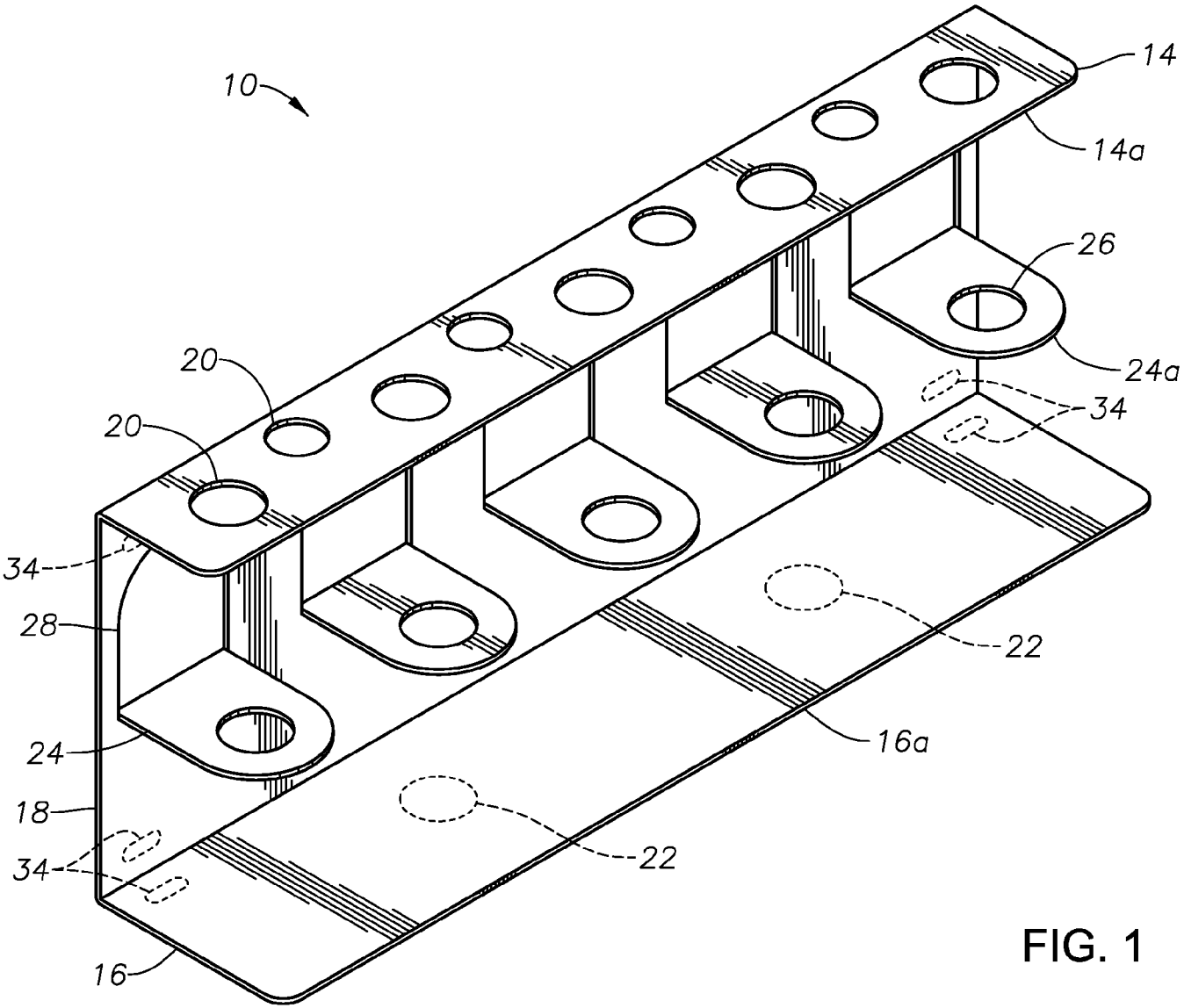
FIG. 1 is a perspective view of a support rack in accordance with an embodiment of the present disclosure.

Certain terminology is used in the following description for convenience only and is not limiting. Unless specifically set forth herein, the terms "a," "an" and "the" are not limited to one element but instead should be read as meaning "at least one." The terminology includes the words noted above, derivatives thereof and words of similar import.

Referring to the drawings in detail, wherein like numerals indicate like elements throughout, FIGS. 1-7 illustrate a support rack, generally designated 10, and a method of supporting one or more at least generally elongated objects 12 (see FIG. 5) in an efficient and cost-effective manner. Each object 12 may be any of a variety of tools, sporting equipment, entertainment devices, or the like in which it is desirable to temporarily or permanently store and access the item in a convenient, space-saving manner. For example, the object 12 may be one or more fishing rods, fishing nets, spears, baseball bats, hockey sticks, golf clubs, skis, poles, brooms, rakes, tree saws each on the end of a pole, shovels, wooden dowels or planks, flags, umbrellas, walking canes, or the like or any combination thereof.

The support rack 10 may include a plurality of uniquely arranged or formed plates 14, 16, 18 and/or tabs 24 to provide the convenient storage of and access to the objects 12. In particular, the support rack 10 may include a first plate 14, a second plate 16, and a third plate 18. The term "plate" is broadly defined herein, and may include any generally flat, elongated structure having considerable length and breadth as compared with its thickness. The first plate 14 extends in a first plane and the second plate 16 extends in a second plane. The first and second planes may extend generally, if not exactly, parallel to one another and may be spaced apart a predetermined distance, such as approximately eight inches. The third plate 18, which extends from the first plate 14 to the second plate 16, extends in a third plane. The third plane may extend generally, if not exactly, perpendicular to the first and second planes.

Figure 3:
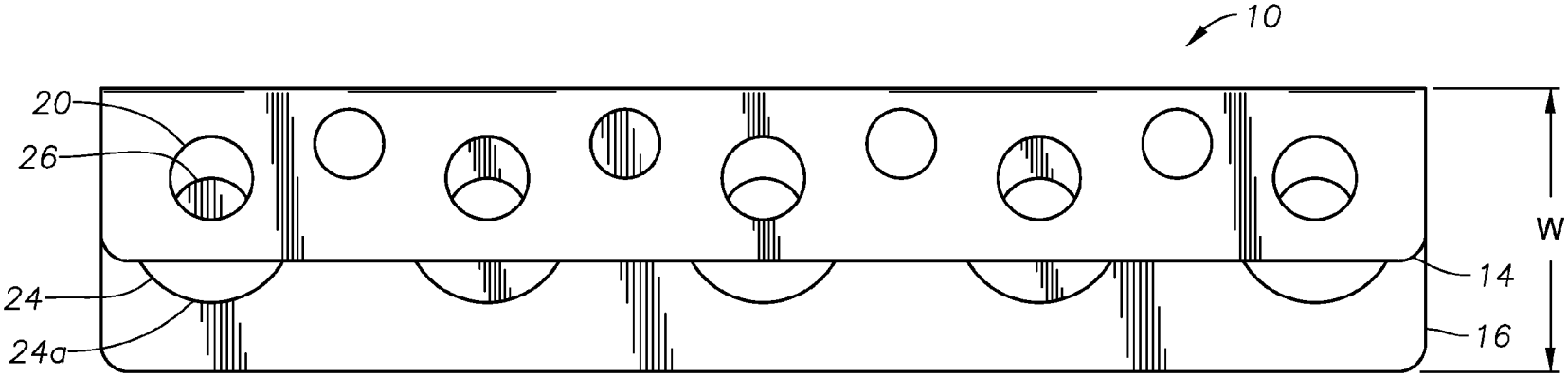
FIG. 3 is a top plan view thereof.
Figure 5:
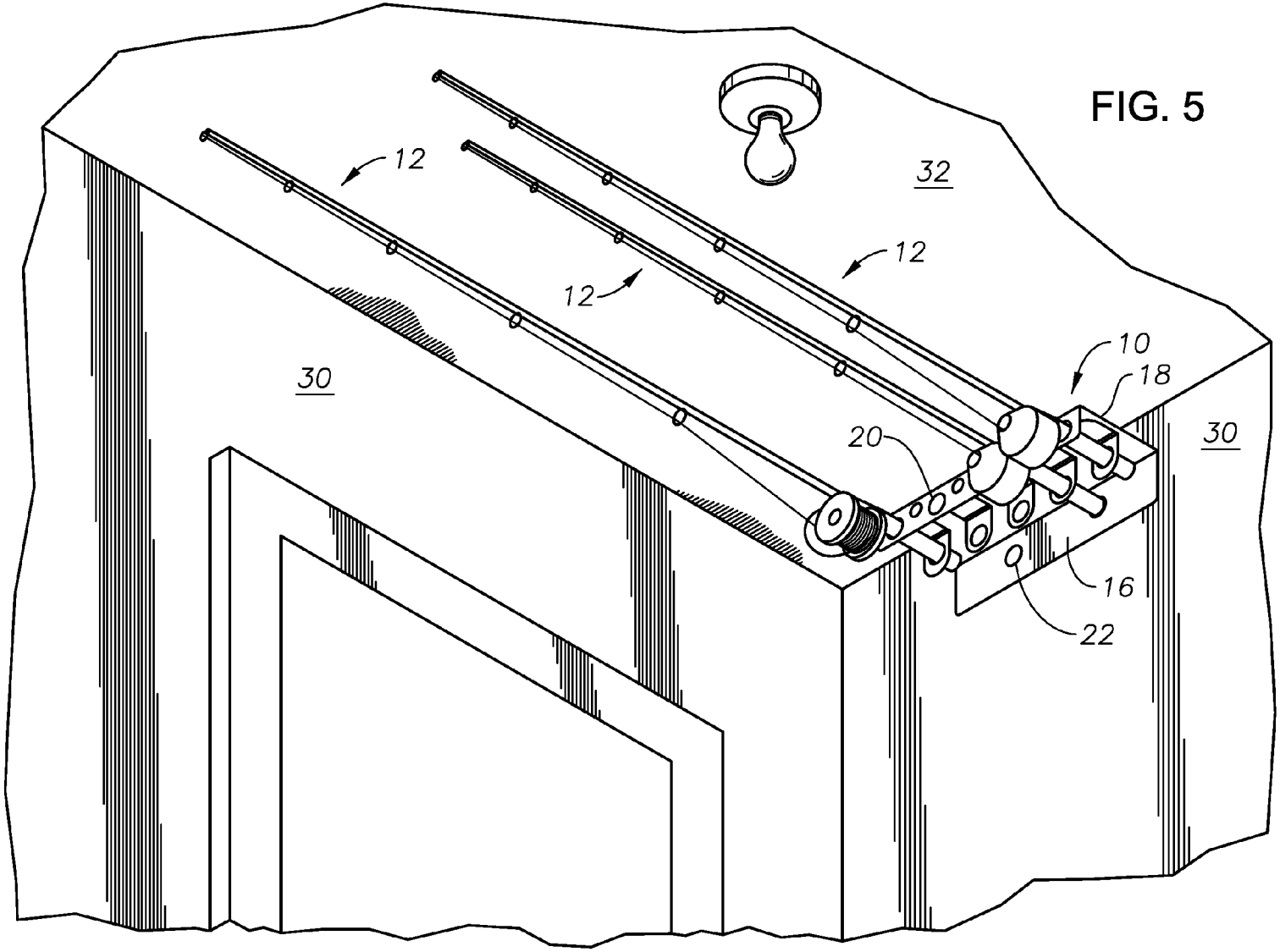
FIG. 5 is a perspective view of the support rack attached to a wall and/or a ceiling.

Referring to FIGS. 1, 3 and 5, the first plate 14 may include one or a plurality of spaced-apart openings 20 that extend completely therethrough. Each opening 20 may have at least a generally circular shape. However, the openings 20 are not limited to such a shape, and each opening 20 is not required to have the same size and/or shape. For example, each opening 20 may have a generally oval, square or rectangular shape. An outer periphery of each opening 20 may be spaced a predetermined distance inwardly from any one of four outer edges of the first plate 14. A distal or free end 14*a* of the first plate 14 may be at least partially or entirely linear.

Each opening 20 of the first plate 14 may have the same or substantially the same diameter, or certain openings 20 may have larger diameters than other openings 20. For example, adjacent openings 20 may have different diameters, while every other opening 20 may have the same or substantially the same diameter. The first plate 14 may include nine of the openings 20, with five of the openings 20 having a larger diameter and four of the openings 20 having a smaller diameter. All of the openings 20 may be aligned in a linear formation with respect to the free end 14*a* of the first plate 14, or the openings 20 may be staggered or aligned in an off-set formation from the free end 14*a* of the first plate 14 (see FIGS. 1 and 3). At least some or each of the openings 20 may have a diameter of approximately one and one quarter inches (1.25 in.). However, the openings 20 of the first plate 14 are not limited to such dimensioning.

In contrast to the first plate 14, the second plate 16 may be completely solid without any openings or holes. The support plate 10 can perform the functionality described herein without any openings in the second plate 16. Alternatively, to possibly add functionality or additional support for one or more of the objects 12, the second plate 16 may include one or a plurality of spaced-apart openings 22 (see FIG. 5, and shown in phantom in FIG. 1) that extend completely therethrough. Each opening 22 may have at least a generally circular shape, but the openings 22 are not limited to such a shape.

Figure 4:
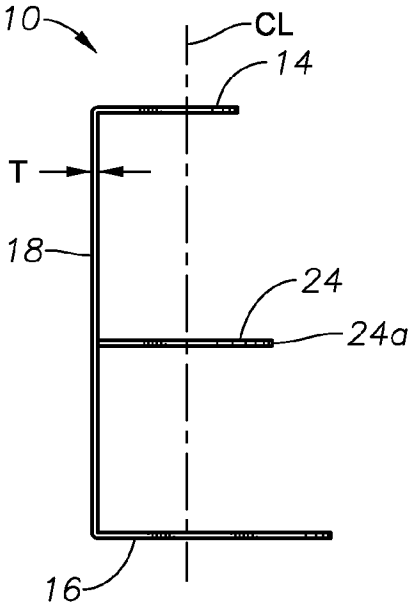
FIG. 4 is a side elevation view thereof.

As shown in FIG. 4, each opening 22 of the second plate 16 may be aligned along a common longitudinal axis CL with one of the fiver larger openings 20 of the first plate 14. The support plate 10 may include two or more laterally spaced-apart and parallel common longitudinal axes CL, each of which extends through a pair of the openings 20, 22. However, for clarity purposes, only a single common longitudinal axis CL is shown in FIG. 4. For each pair of openings 20 of the first plate 14 and openings 22 of the second plate 16, the common longitudinal axis CL may extend through a geometric center of each openings 20, 22. Alternatively, the geometric centers of each pair of openings 20, 22 may be off-set or misaligned. A distal or free end 16*a* of the second plate 16 may be at least partially or entirely linear.

The support rack 10 may further include one or more laterally spaced-apart tabs 24. In one embodiment, the support rack 10 may include five spaced-apart tabs 24. Each tab 24 may be formed by stamping or pressing a portion of the third plate 18 so as to be bent to extend outwardly from the third plate 18. In such an embodiment, one passageway 28 may be formed in the third plate 18 for each tab 24 that is formed (see FIGS. 1 and 2). The shape of the passageway 28 associated with each tab 24 may generally, if not exactly, match the shape of the outer periphery of the tab 24. Alternatively, each tab 24 may be formed separately from the third plate 18 and removably or permanently attached thereto.

The tabs 24 may extend substantially or completely in a fourth plane. As shown in FIG. 4, the fourth plane may be positioned between and spaced-apart from both the first plane and the second plane. The fourth plane may extend generally, if not exactly, parallel to both the first plane and the second plane. Thus, each tab 24 and the fourth plane may extend generally, if not exactly, perpendicularly to the third plate 18 and the third plane. The tabs 24 may extend outwardly from the third plate 18 at a distance similar (e.g., equal) to or at least slightly greater than the first plate 14 (see FIG. 4). The tabs 24 may extend outwardly from the third plate 18 less than the second plate 16. As shown in FIG. 1, a distal or free end 24*a* of each tab 24 may be at least partially arcuate or curved.

Each tab 24 may include at least one opening 26 extending completely therethrough. The opening 26 may be at least generally circular in shape, but the opening 26 is not limited to such a shape. The opening 26 may have a diameter of approximately one and one half (1.5) inches. The opening 26 of each tab 24 may be aligned with one of the openings 20 of the first plate 14 along one of the common longitudinal axes CL (see FIG. 4). For each combination of an opening 20 of the first plate 14 and the opening 26 of one of the tabs 24, the common longitudinal axis CL may extend through a geometric center of each openings 20, 26. Alternatively, the geometric centers of each pair of openings 20, 26 may be off-set or misaligned.

Figure 6:
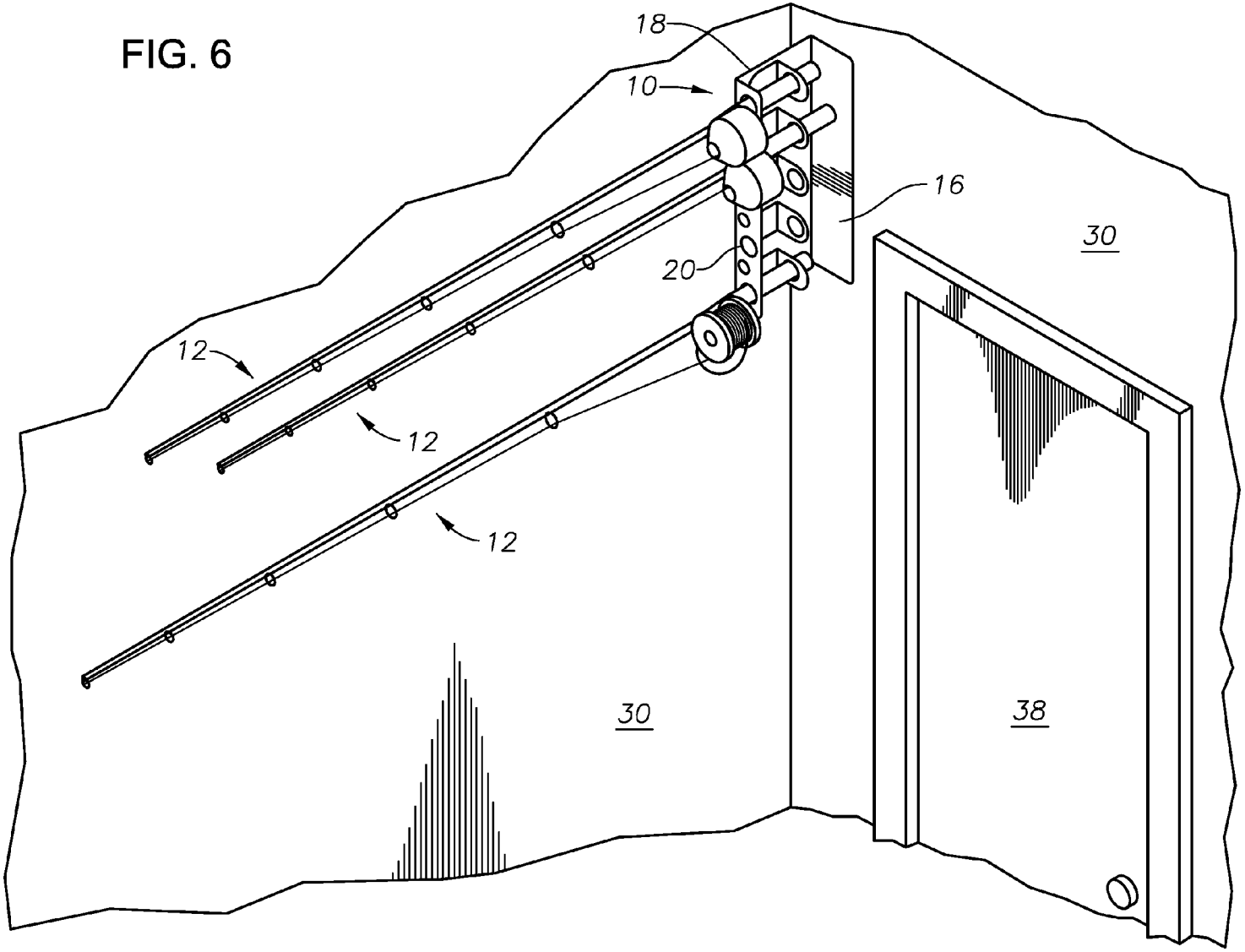
FIG. 6 is a perspective view of the support rack attached to one or more walls.
Figure 7:
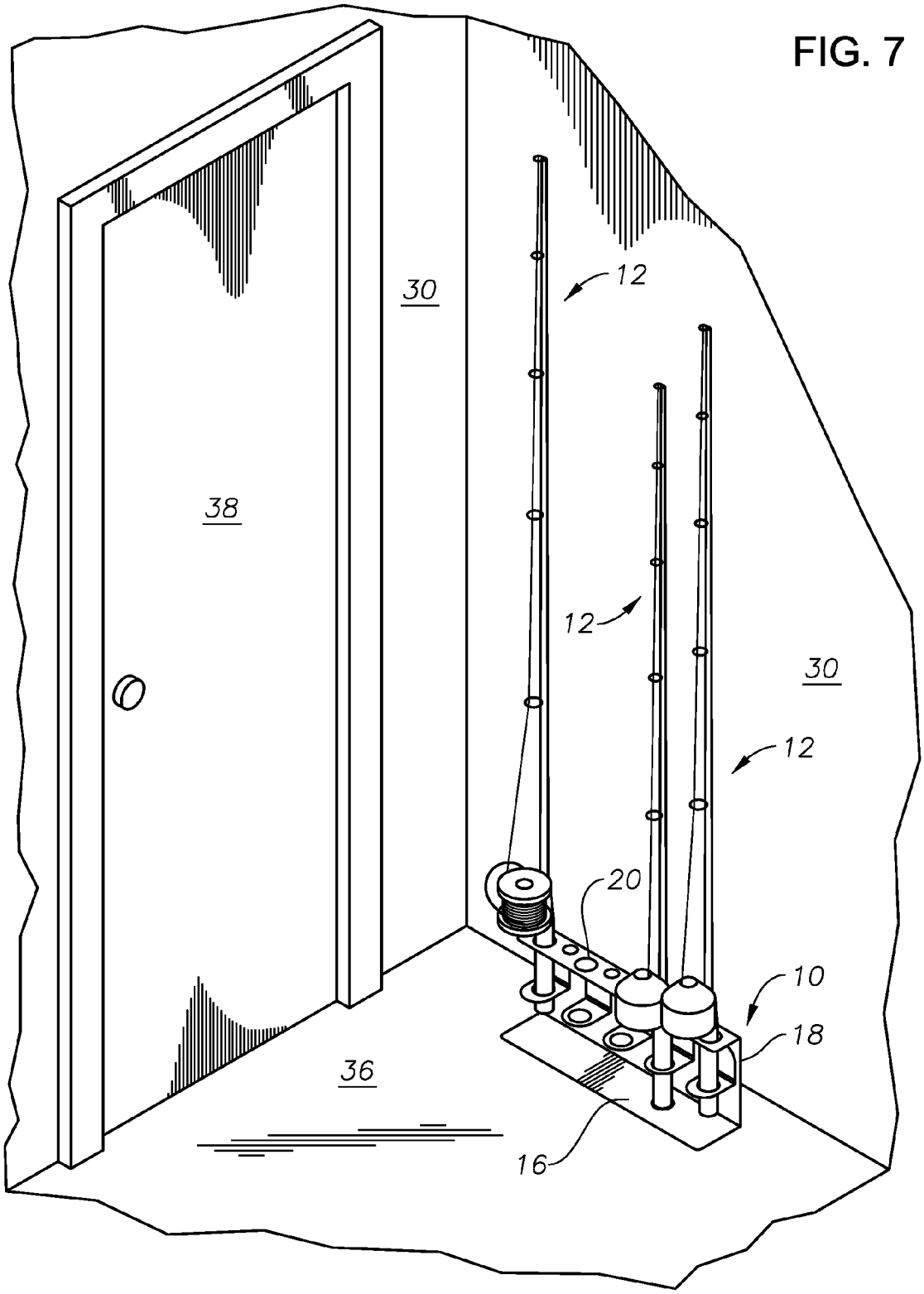
FIG. 7 is a perspective view of the support rack attached to a floor and/or a wall.

As shown in FIGS. 5-7, the support rack 10 may be permanently or removably attached to a portion of a wall 30, a ceiling 32, a support surface (such as a floor 36) and/or a door 38. In particular, the second plate 16 and/or the third plate 18 may include one or more apertures 34 (shown in phantom in FIG. 1) to receive at least a portion of a fastener, such as a screw, nail or bolt, therethrough. Each aperture 34 may be countersunk. Alternatively or additionally, the support rack 10 may be attached to a floor 36, a door 38, a ceiling 32 and/or a wall 30 by adhesive. Furthermore, the support rack 10 may be attached to a floor 36, a door 38, a ceiling 32 and/or a wall 30 by driving or screwing one or more of the fasteners through a solid portion of the support rack 10 or one or more of the openings 22 of the second plate 20. When mounted, as described above, the support rack 10 is configured to support at least one and preferably a plurality of the objects 12, which may be inserted at least into one of the openings 20 of the first plate 14 and the opening 26 of one of the tabs 24.

The support rack 10 may be integrally, unitarily and/or monolithically formed. For example, the support rack 10 may be formed of a one-piece metallic material, such as aluminum. The support rack 10 may be stamped or pressed to form the first plate 14, the second plate 16, the third plate 18, and/or the tabs 24. Thus, the support rack 10 may be formed without welding. Alternatively, the support rack 10 may be formed of a polymeric material and may be formed by a molding operation.

In an embodiment in which the support rack 10 is formed from a metallic material, the above-described features of the support rack 10 may be formed by cutting, drilling and/or bending a single sheet of metallic material. For example, portions of a midsection of the metallic sheet may be cut to outline the plurality of spaced-apart tabs 24. Each tab 24 may then be bent ninety degrees from the sheet. Previously or subsequently, one end of the sheet may be folded or bent approximately ninety degrees to form the first plate 14 and an opposite end of the sheet may be folded or bent approximately ninety degrees to form the second plate 16. The openings 20 in the first plate 14, the openings 22 in the second plate 16, and the opening 26 in each tab 24 may be formed prior to or after the above-described steps.

A method of supporting the objects 12 may include attaching at least a portion of the support rack 10 to at least one or both of a ceiling 32 and a vertical wall 30 and inserting at least a portion of one of the objects 12 into at least one of the openings 20, 22, 26 formed in the support rack 10. The method may result in a longitudinal axis of the object 12 extending at least generally, if not exactly, parallel to a plane defined by the ceiling 32. The support rack 10 may be attached to and contact either or both the ceiling 32 and the wall 30. For example, a rear surface of the third plate 18 may directly engage and extend parallel to the ceiling 32. Additionally or alternatively, a rear surface of the second plate 16 may directly engage and extend parallel to the wall 30 (see FIG. 5), or the rear surface of the second plate 16 may directly engage and extend parallel to a ground surface or the top of a counter or table. The support rack 10 permits a plurality of the elongated objects 10 to extend in a parallel and spaced-apart manner.

As shown in FIG. 6, the support rack 10 may be positioned so that the plurality of elongated objects 10 extends horizontally, but are stacked vertically with respect to each other. Alternatively, the support rack 10 may be positioned so that the plurality of elongated objects 10 extends vertically, but are laterally spaced-apart from each other (see FIG. 7). Only one of the second plate 16 and the third plate 18 may at least partially or completely contact one of a wall 30, a ceiling 32, a floor 36 or a door 38. In such a mounting orientation, the other of the second plate 16 and the third plate 18 may extend parallel to but at least slightly spaced-apart from a wall 30, a ceiling 32, a floor 36 or a door 38.

A benefit of attaching the support rack 10 to the ceiling 32 and/or high on a vertically-extending wall 30 is that the support rack 10 does not occupy space on the ground or interfere with other objects or pathways. In such a configuration, the objects 12 are stored in a horizontal manner (e.g., parallel to the ground surface). Alternatively, the support rack 10 may be placed on mounted on the floor for storage of the objects 12 in a vertical manner (e.g., perpendicular to the ground surface). The support rack 10 can also be placed or mounted in or on a vehicle, such as on the floor or in the back of a pick-up truck or on an all-terrain vehicle. More specifically, the support rack 10 may be placed or mounted on a truck bumper for surf fishing, or on or in a boat for transport or fishing purposes.

Figure 2:
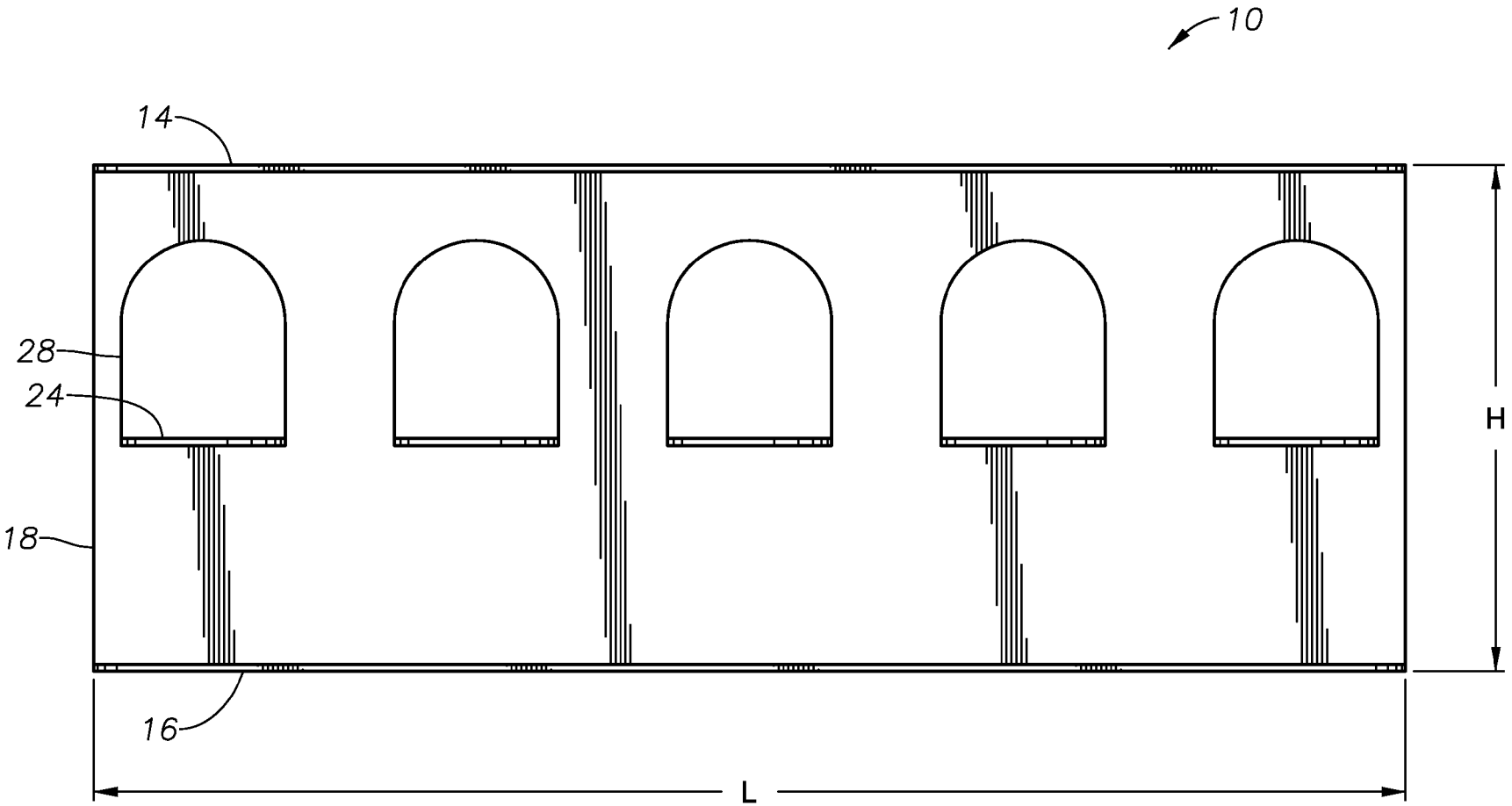
FIG. 2 is a front elevation view thereof.

As shown in FIGS. 2 and 3, the support rack 10 may have a length L of approximately or exactly twenty four inches (24 in.), a height H of approximately or exactly eight inches (8 in.), and a width W of approximately or exactly five inches (5 in.). In addition, as shown in FIG. 4, the support rack 10 may have a thickness T of approximately one eight of an inch (⅛ in.). However, the support rack 10 is not limited to such dimensions. In addition, a larger version of the support rack 10 may be formed to hold relatively large objects, such as offshore fishing rods and reels.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A support rack comprising:

a first plate extending in a first plane, at least two spaced-apart openings extending through the first plate, an entire outer periphery of each of the openings being spaced inwardly from each edge of the first plate;

a second plate extending in a second plane, the second plane being parallel to and spaced-apart from the first plane;

a third plate extending from the first plate to the second plate, the third plate extending in a third plane, the third plane extending perpendicularly to both the first and second planes, the second plate extending outwardly from the third plate further than the first plate; and at least one tab extending outwardly from the third plate and between the first and second plates, the tab extending perpendicularly to the third plane and parallel to both the first and second planes, the tab including an opening extending therethrough, the opening of the tab being aligned with one of the openings of the first plate along a common longitudinal axis.

2. The support rack according to claim 1, further comprising:

at least two spaced-apart tabs extending outwardly from the third plate and between the first and second plates, each tab extending perpendicularly to the third plane and parallel to both the first and second planes, each tab including an opening extending therethrough, the opening of each tab being aligned with one of the openings of the first plate along a common longitudinal axis.

3. The support rack according to claim 2, wherein the support rack is configured to support an elongated object inserted into one of the at least two spaced-apart openings of the first plate and the opening of one of the at least two spaced-apart tabs.

4. The support rack according to claim 3, wherein the elongated object is a fishing rod.

5. The support rack according to claim 1, wherein the second plate includes at least two spaced-apart openings extending therethrough.

6. The support rack according to claim 5, wherein at least one of the openings of the second plate is aligned with one of the openings of the first plate and the opening of one of the tab along the common longitudinal axis.

7. The support rack according to claim 1, wherein the support rack is formed of aluminum without welding.

8. The support rack according to claim 1, wherein the first plate, the second plate, the third plate and the tabs are unitarily formed.

9. A method of supporting a plurality of fishing rods in parallel in a support rack, the support rack including a first plate extending in a first plane, a second plate extending in a second plane, the second plane being parallel to and spaced-apart from the first plane, a third plate extending from the first plate to the second plate, the third plate extending in a third plane, the third plane extending perpendicularly to both the first and second planes, at least one tab extending outwardly from the third plate and between the first and second plates, the tab extending perpendicularly to the third plane and parallel to both the first and second planes, the tab being spaced-apart from the first and second plates, the method comprising:

attaching at least a portion of the support rack to at least one of a ceiling and a wall;

inserting at least a distal end of one of the fishing rods into at least one opening formed in the first plate of the support rack; and inserting at least the distal end of the one of the fishing rods into an opening of the tab such that the fishing rod extends at least generally parallel to a plane defined by at least one of the ceiling and the wall.

10. The method according to claim 9, wherein at least a portion of the support rack is attached to both the ceiling and the wall.

11. A combination comprising:

at least two fishing rods; and a support rack comprising:

a first plate extending in a first plane, at least two spaced-apart openings extending through the first plate;

a second plate extending in a second plane, the second plane being parallel to and spaced-apart from the first plane;

a third plate extending from the first plate to the second plate, the third plate extending in a third plane, the third plane extending perpendicularly to both the first and second planes, at least two spaced-apart passageways formed in the third plate; and at least two spaced-apart tabs extending outwardly from the third plate and between the first and second plates, each tab extending perpendicularly to the third plane and parallel to both the first and second planes, an outer periphery of each tab having a corresponding size and shape to an inner periphery of one of the passageways in the third plate, each tab including an opening extending therethrough, the opening of each tab being aligned with one of the openings of the first plate along a common longitudinal axis, wherein the support rack is configured to support the at least two fishing rods, each fishing rod being inserted into one of the at least two spaced-apart openings of the first plate and the opening of one of the at least two spaced-apart tabs.

12. The combination according to claim 11, wherein the support rack is attached to a wall.

13. The combination according to claim 11, wherein the support rack is attached to a ceiling.

14. The combination according to claim 11, wherein the support rack is attached to a floor.

* * * * *